United States Patent [19]

Cunill

[11] Patent Number: 4,981,076

[45] Date of Patent: Jan. 1, 1991

[54] CENTRALIZING DEVICE FOR PREPARING A SILK SCREEN FOR A SILK SCREEN PRINTING MACHINE

[76] Inventor: Angel S. Cunill, Cuidad de Granada Nos. 130-134, 08018 Barcelona, Spain

[21] Appl. No.: 374,483

[22] Filed: Jun. 30, 1989

[30] Foreign Application Priority Data

Jul. 12, 1988 [ES] Spain ..... 8802182

[51] Int. Cl.[5] ..... B05C 17/08

[52] U.S. Cl. ..... 101/127.1; 101/DIG. 36; 33/616; 33/614

[58] Field of Search ..... 101/127.1, 128.4, DIG. 36, 101/128.1, 128.21, 129; 33/614, 616, 617, 621, 620

[56] References Cited

U.S. PATENT DOCUMENTS

| | | | |
|---|---|---|---|
| 2,455,735 | 12/1948 | Condaux | 101/DIG. 36 |
| 2,487,542 | 11/1949 | Haff | 191/DIG. 36 |
| 2,793,442 | 5/1957 | Ozga | 101/DIG. 36 |
| 2,984,910 | 5/1961 | La Cour | 101/DIG. 36 |
| 4,463,673 | 8/1984 | Moore | 101/DIG. 36 |
| 4,827,626 | 5/1989 | Wieland | 33/614 |

FOREIGN PATENT DOCUMENTS

| | | | |
|---|---|---|---|
| 115849 | 7/1984 | Japan | 101/DIG. 36 |
| 14918 | 11/1914 | United Kingdom | 101/128.4 |

OTHER PUBLICATIONS

IBM Technical Disclosure Bulletin, vol. 21, No. 8, Jan. 1979.

*Primary Examiner*—Edgar S. Burr
*Assistant Examiner*—Ren Yan
*Attorney, Agent, or Firm*—Robert E. Burns; Emmanuel J. Lobato

[57] ABSTRACT

This system consists of two fundamental devices based on a holder frame in which the screen to be insulated is embedded and remains fixed to the first frame by means of applying a third frame equipped with embedding elements. Once the silk screen has been insulated, it passes to a screen holder frame situated on the silk screen printing machine, in which the screen is embedded by means of fixed adjustable screws that are self-centering and the whole unit is attached to the screen holder frame, by means of a conventional pin adjuster. The entire process of the system should be followed in order to obtain maximum results.

3 Claims, 2 Drawing Sheets

CENTRALIZING DEVICE FOR PREPARING A SILK SCREEN FOR A SILK SCREEN PRINTING MACHINE

DESCRIPTION

1. Purpose of the Invention

This invention refers to a centralizing system and device for exposing the screen to light and centralizing it in silk screen printing machines, the clear object of which is to facilitate the adjustment and centralizing work in this type of machine, thus ovecoming the multiplicity of steps needed each time a silk screen process must be prepared, culminating subsequently in the centralizing of the silk screens when they are transferred to the machine for printing on any object.

2. Background of the Invention

As is known, to prepare a silk screen printing machine for operation, a series of steps must be taken prior to printing.

In the first place, the object to be exposed to light must be prepared, centralizing it in a given area, then exposing the screen which is subsequently placed in the silk screen printing machine so that the image on the screen is exactly printed on the object being worked on; it has to be remembered that this exposed image must be formed with certain features; and with certain measures according to the work being done.

At present, in order to expose a silk screen to light, the original is placed on an element or carrier glass: over it is placed the screen to which the image is to be transferred and which will later be used on the silk screen printer in order, in turn, to transfer the image shown on to the object, with its corresponding exposure.

Naturally, this preliminary screen exposure work needs special treatment involving a substantial period of time and the employment of persons with quailifications, together with special detailed and precision treatment.

Subsequently, for correct printing, a decisive factor in a good job is the centralizing of the image on the screen so that the screen printing professional has to carry the acreen and place it in securing devices, then, once it is placed on the machine, to center it over the object.

For this centering over the object, it is absolutely essential to make a millimetric adjustment, which is followed by a series of test prints which make it quite clear that the final print is completely correct, and to the operator's satisfaction.

These operations go hand in hand with a series of obstructive details which lead not only to a substantial loss of time for the preparation of the machine when it is necessary to do different prints on objects, but also to an economic loss because of the test series required on the objects to be certain that the printing is perfect.

Moreover, it can be said that there are many jobs in silk screen printing which involve the application of different prints on a single object, for each of which a new screen is required, for reasons inherent to the printing to be done.

In addition to this, it is obvious that if each of these prints requires a change of screen and, therefore, centralization of millimetric precision, a further set of operations will be required for which it is easy to see that there will be a substantial waste of time and the machines' performance is impaired, not just financially but, as well, their productive efficiency is very notably reduced.

As an example, we can say that the folowing is the system now used each time a screen is removed and replaced by another.

Firstly the support is removed, followed by the second support.

The fitted screen is then taken out and a new one put in its place, positioning the front stopper bar and tightening the front and back securing clamps.

Then the table clamps are loosened and the table/-screen image is centralized. Naturally, this must be done several times until exact. The table is then clamped and the second support and support are refitted. Their heights are then corrected, and the machine is now ready to operate, i.e. to print, once more.

With these successive operations, a large nember of bolts must be handled: this takes up a huge amount of time.

The obvious solution to these problems would be to have a system whose components make it possible to centralize the screen when it is exposed, with the subsequent centralization of the screens on the printing machines, without the need to carry out a series of adjustments each time the screen is changed. However, until the present, no system has been found which can consistently avoid this set of precision tasks which are seen to disrupt the silk screen printing proccess.

There have been some attempts to do these adjustments with highly sophisticated silk screen printers but, with the passage of time, it has been shown that, although the work was madde easier, the operator was not released from the system whose disadvantage was in having to adjust the screens one by one each time they were changed.

It is thus seen that the solutions adopted so far have proven to be inoperable.

DESCRIPTION OF THE INVENTION

The centralizing device system for screen exposure and centralizing in silk screen printing machines proposed in this invention constitutes an extremely simple and therefore low cost solution which is easy to introduce into all silk screen printing processes at the same time as offering optimal guarantees of quality: it also provides easy screen handling, giving them a series of reliable security factors.

To do this, in more specific terms, the invention put forward has a centralizing device for the exposure of silk screens comprising a rectangular body to form a frame, the lower part of which is covered in glass, on which there is a set of markings which help and collaborate effectively in placing the image to be exposed on the screen.

At each end of this frame , in the top, there are some round openings.

In the central space of the frame, there is a second frame which carries the screen iself, which has the same dimensions as the inside of the initial screen.

As pointed out above, in this second frame, from now on referred to as the screen, the exposed image is to be transferred, after having been placed on the glass at the bottom of the first frame, which is conveniently fastened to the frame, e.g., with glue.

At each end of the screen there is a round opening and, as on the first frame, these are located at each end in the top.

To complete the whole assembly, with the aim of providing a connection and fastening which is immobile during the exposure process, a third frame is placed on top: this frame is the same size as the assembly of the other two, but it leaves the screen space open.

At each end of this third frame, now in the bottom, there are two spindles or spigots which fit into the holes in the ends of the first frame where the image for exposure is placed, and in the holes in the ends of the screen: this forms a compact body so preventing the screen from being moved at all, which means that all the screens exposed to light have their image in the same position, and the operator cannot unwittingly move them.

Once the screen is exposed the operator removes the third frame covering the screen and frame on which the image is placed: all that is needed is to remove the fastening spigots, then lifting out the exposed screen which is then taken to the silk screen printing process in the machine concerned. As many exposed screens, with the image in the same position, are available as may be required and there is no need whatsoever to make rectifications and corrections after each exposure operation.

Naturally, a technician with specialization in the matter will understand clearly that it is sometimes necessary to do a series of exposure operations on screens which are subsequently to be printed onto a single object: however, these printings are individualized, so that the element to be worked must be subjected to different printing processes.

In summary, it can be deduced that the image to be exposed was placed in the first instance within certain margins on a millimetric scale, or else on marking points on the glass at the bottom of the first frame. The points chosen for an initial exposure operation can be used to locate other images for exposure, and which will subsequently be included in the object to be printed: of course, all the measurements and scales are retained, so that the images reproduced by exposure on the successive screens will all be exactly aligned with the first one, and these screens do not need to be centralized on the object, as they have been derived from an original located in the same position, even though ore than one exposure has been done, with successive placements and withdrawals.

Once the exposed screen is available, using the system put forward here, it is taken to the silk screen printing machine itself, where it is connected to a chassis or screen holder which receives the screen holding the image to be reproduced and which has fastening spindles of the self-centering type, at the back, in the front top, and in the side. There are further self-centering spindles in the top front.

Naturally, the support for this screen holder has the housings required for the introduction, fitting and fastening of the mobile side spindles and the fixed rear ones, as well as for those at the top which are basically intended to prevent any movement of the screen.

With the action of the housings and spindles referred to, the screen is fastened to its holder: the whole assembly is then secured to the machine, using standard fasteners, such as a clamp.

It can be said in summary that the screen holder has four fixed self-centering spindles, and two mobile spindles, for the fastening of the screen.

Two of the four fixed spindles are located at the back of the screen holder, while the other two are in its top front part. The role of the two at the back is to prevent any sideways and vertical movement of the back of the screen, while the two front spindles are basically designed to prevent sideways movement at the front and, at the same time, to ensure that there is no backward or forward movement of the screen.

The two mobile spindles are intended to prevent the front of the frame from falling, fastening it securely to the assembly formed with the screen holder and the machine. They are activated with two levers in the front of the screenholder: of course any other standard fastening system can be incorporated.

The screen holder is fastened to the silk screen printing machine in the same way as used at present for standard screens: as this is the housing for all the screens used with the same format, they are fitted to the silk screen printing machine once only.

The outcome of the use of this system is clearly a substantial saving of time, ensuring that, with the screen changing process being done in a minimum time, thanks to this new system, the present adjustments are no longer necessary.

Finally, we must point out that, in order to completely fasten the screen, the screen holder and the machine, a standard clamp is used to immobilize the whole assembly so that it cannot be shifted and it takes on considerable solidity.

In summary, it can be said that, to operate with the new system and change the screen, the fastening clamp is pressed, then the screen is removed: a new screen is put in its place for work, and the fastening component is released.

The centralization is then checked and readjusted if necessary.

It can be assured, one hundred percent and authentically, that the complexity of exposure of the screens is decisively simplified, and the time required for the installation of a screen in a silk screen printing machine is reduced by 94%.

DESCRIPTION OF THE DRAWINGS

To complete the description given and so as to aid in a better grasp of the features of the invention, these specifications are accompanied by two pages of drawings, forming an integral part hereof, which, by way of illustration and without limitation, show the following.

A PREFERENTIAL DESIGN FOR THE INVENTION

Figure 1:
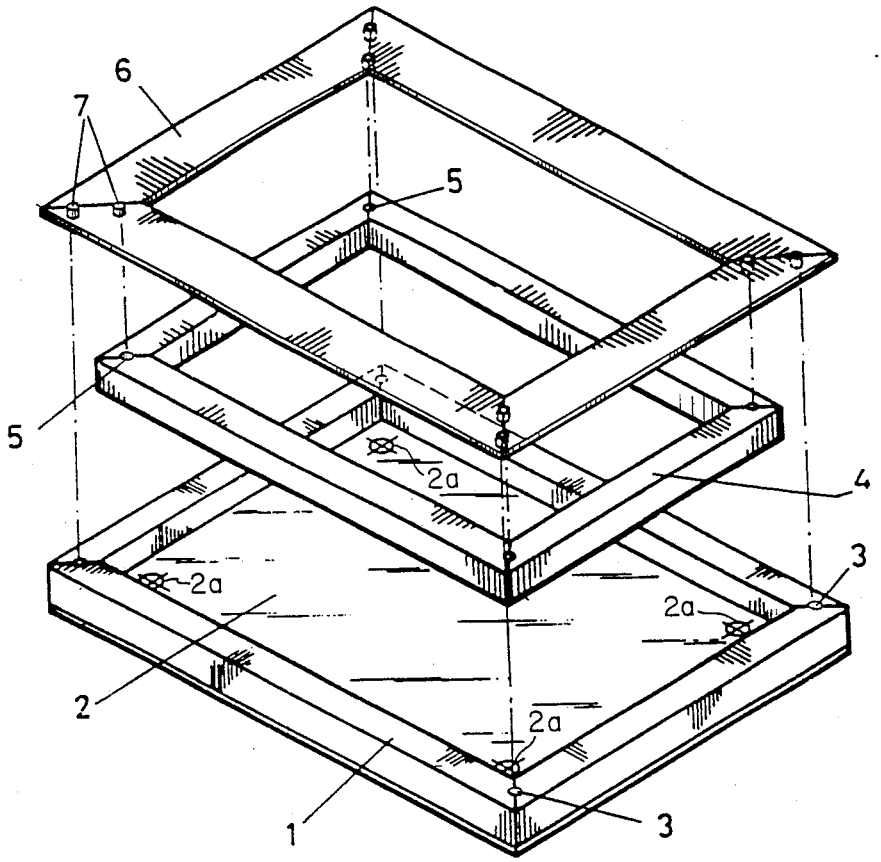
FIG. 1 shows a perspective view of the three parts making up the device applied in this system for screen centralization.
Figure 2:
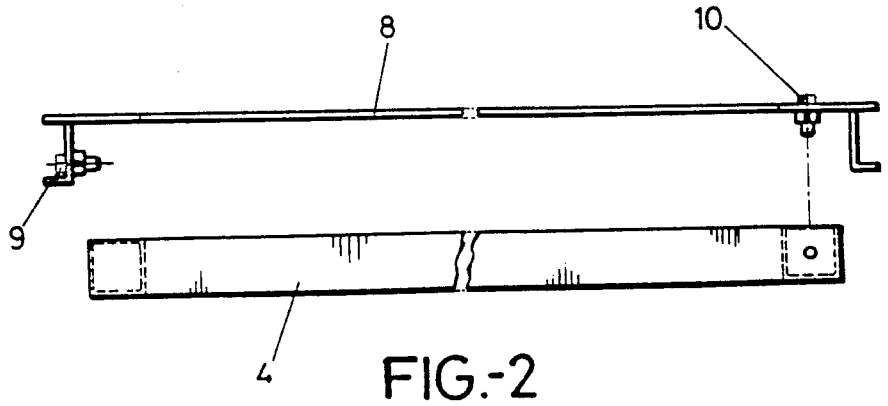
FIG. 2 shows a side view of the screen holder, fastened onto the silk screen printing machine.

From these figures, it can be seen how the centralizing system and device for screen exposure and centralizing on silk screen printing machines is based on a centralizing device for exposure of silk printing screens, made up of a modular frame (1) which, at the bottom, has a piece of glass (2) fixed in place by standard means, and on which is the image to be exposed, placed according to the requirements of the job to be done. On the glass (2) there is a set of markings (20) which help in locating the image on the glass.

Frame 1 has round openings (3) at the ends, for the fitting of fastening spigots. Inside said frame (1), following and connected to its dimensions, a screen (4) is fitted in, which is where the image superimposed on the glass (2) is to be exposed.

The silk printing screen (4) has openings (5) at each end, aligned with those (3) in the top of the frame (1).

So as to immobilize the frame (1) with the screen (4), a third frame (6) is placed over both: it has spindles (7) which fit into the openings (3) and (5), so as to secure the assembly completely.

Of course, with the application of the frame (6), the spindles (7) fit inside the openings (3) and (5), so that the frame (4) on the glass (2) of frame (1) is easily immobilized and as many screens can be exposed for a given purpose as may be required, without any possibility of movement.

It can be seen from the figure that frame (1) holds frame (4), in its interior, and these are joined together by frame (6), with spindles (7) which fit exactly into the openings in the upper part of the first two frames (3) and (5).

It must be emphasized that frame (1) contains screen (4) and both are secured by the fitting of the spindles (7) on the bottom of frame (6).

Once screen (4) has been exposed, it is moved to the silk screen printing machine and is fitted in a structure or screen holder (8) with self-centering pivots at the back (9), and a further set of pivots in the top (10), which fit into the openings in screen (4).

As already pointed out, these are self-centering pivots which place the screen in its best operating position.

As can be seen, screen (4) is fixed to the screen holder structure (8) by the standard clamp (11) which has a standard adjustment system, by tightening and movement of its upper part, locking and releasing the assembly.

The clamp (11) holds the assembly by fitting its side pivots in openings on the screen sides.

Naturally, the assembly can be provided with any other standard securing system: the pivot fitting system may be eliminated completely in favour of the side-pressure-zone securing system.

Figure 3:
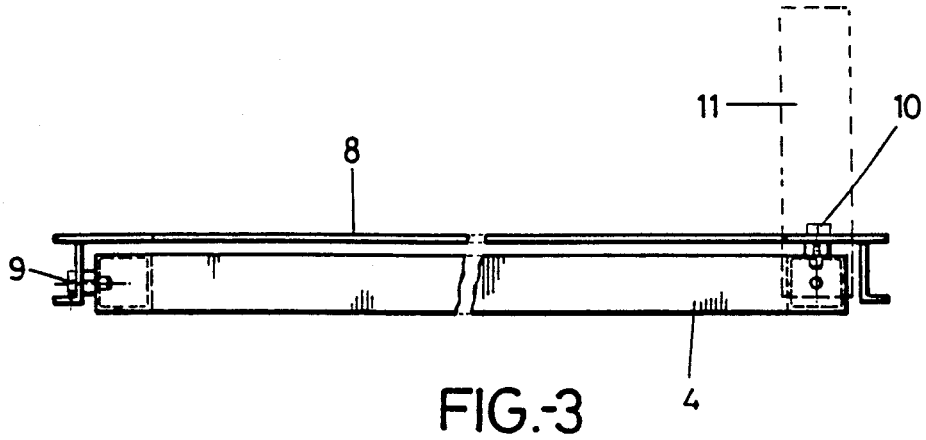
FIG. 3 once more shows a side view of the screen holder, with the silk screen connected.
Figure 4:
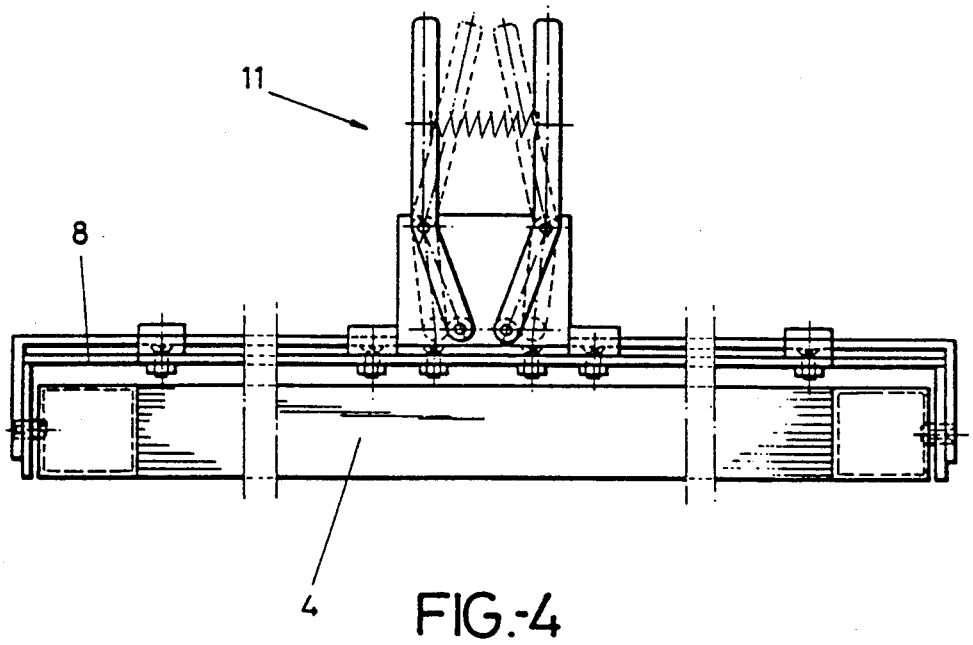
FIG. 4 finally shows a frontal view of the screen holder with the screen fitted and, on the top, the clamp securing the assembly.

FIG. 3 shows in dotted lines how clamp (11) is placed laterally in the front of the screen and screen holder assembly.

It is not thought necessary to extend this description further for any expert in the subject to understand the scope of the invention and the advantages arising therefrom.

The materials, shape, size and layout of the components are susceptible to variation, provided that this does not alter the essence of the invention.

The terms of these specifications must be interpreted in the broad sense, without limitation, at all times.

I claim:

1. A centralizing device for preparing a silk screen for a silk screen printing machine comprising:

a first rectangular frame having, at opposite ends, upwardly holes, a glass plate secured on a lower side of said first rectangular frame, said plate being provided with means for locating on said plate an image to be transferred to said silk screen, a second rectangular frame carrying a silk screen that is being prepared, said second rectangular frame being of a size and shape to fit inside said first rectangular frame and having at opposite ends upwardly opening holes, said second rectangular frame being assembled with said first rectangular frame by fitting inside said first rectangular frame and resting on said glass plate, and a third rectangular frame having, in plan, the same dimensions as said first rectangular frame and said second rectangular frame assembled and having on its lower side downwardly projecting spindles positioned to fit in said upwardly opening holes of said first rectangular frame and said upwardly opening holes of said second rectangular frame, said third rectangular frame being assembled with said first and second rectangular frames with said spindles of said third rectangular frame fitting in said holes of said first and second rectangular frames, said screen being thereby positioned relative to said image for exposure to light through said glass plate to transfer said image to said screen.

2. A centralizing device according to claim 1, in which said means for locating an image on said glass plate comprise markings on said glass plate.

3. A cenralizing device according to claim 1, in which the upper surface of said second rectangular frame is substantially flush with the upper surface of said first rectangular frame when said first and second rectangular frames are assembled with one another.

* * * * *

. UNITED STATES PATENT AND TRADEMARK OFFICE

CERTIFICATE OF CORRECTION

PATENT NO. : 4,981,076

DATED : Jan. 1, 1991

INVENTOR(S) : Angel Sanabra Cunill

It is certified that error appears in the above-identified patent and that said Letters Patent is hereby corrected as shown below:

In column 1 of the Title Page, item [76], correct the inventor's name as follows:

[76] Inventor: Angel Sanabra Cunill, Cuidad de Granada

Also in the heading of the title page, correct the inventor's name to: Sanabra Cunill

Signed and Sealed this

Eighteenth Day of August, 1992

*Attest:*

DOUGLAS B. COMER

*Attesting Officer*

*Acting Commissioner of Patents and Trademarks*